US009440452B2

(12) United States Patent
Harada et al.

(10) Patent No.: US 9,440,452 B2
(45) Date of Patent: Sep. 13, 2016

(54) PRINTER, PRINTING SYSTEM, AND METHOD OF PRINTING

(71) Applicants: Yasunari Harada, Kanagawa (JP); Jun Watanabe, Tokyo (JP); Tomoko Fukasawa, Kanagawa (JP); Tetsuyoshi Nakata, Kanagawa (JP); Ryuuichi Satoh, Kanagawa (JP); Hiroki Tanaka, Kanagawa (JP); Toshiaki Hosokawa, Kanagawa (JP)

(72) Inventors: Yasunari Harada, Kanagawa (JP); Jun Watanabe, Tokyo (JP); Tomoko Fukasawa, Kanagawa (JP); Tetsuyoshi Nakata, Kanagawa (JP); Ryuuichi Satoh, Kanagawa (JP); Hiroki Tanaka, Kanagawa (JP); Toshiaki Hosokawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 9 days.

(21) Appl. No.: 14/818,635

(22) Filed: Aug. 5, 2015

(65) Prior Publication Data

US 2016/0082719 A1 Mar. 24, 2016

(30) Foreign Application Priority Data

Sep. 18, 2014 (JP) ..... 2014-189607

(51) Int. Cl.

| | |
|---|---|
| ***B41J 2/36*** | (2006.01) |
| ***B41J 3/36*** | (2006.01) |
| ***B41J 2/045*** | (2006.01) |

(52) U.S. Cl.

CPC ..... *B41J 3/36* (2013.01); *B41J 2/04505* (2013.01); *B41J 2/04586* (2013.01)

(58) Field of Classification Search

CPC ..... B41J 3/36
USPC ..... 347/14, 19, 109
See application file for complete search history.

(56) References Cited

U.S. PATENT DOCUMENTS

| | | | | |
|---|---|---|---|---|
| 8,622,539 | B2 * | 1/2014 | Schwartz | B41J 3/36 347/109 |
| 2006/0050131 | A1 * | 3/2006 | Breton | B41J 3/36 347/109 |
| 2008/0144053 | A1 | 6/2008 | Gudan et al. | |
| 2011/0109678 | A1 * | 5/2011 | Schwartz | B41J 3/36 347/109 |

FOREIGN PATENT DOCUMENTS

| | | |
|---|---|---|
| JP | 2004-106330 | 4/2004 |
| JP | 2008-094101 | 4/2008 |
| JP | 2010-520087 | 6/2010 |
| WO | WO2008/109550 A1 | 9/2008 |

* cited by examiner

*Primary Examiner* — Julian Huffman
*Assistant Examiner* — Sharon A Polk
(74) *Attorney, Agent, or Firm* — Cooper & Dunham LLP

(57) ABSTRACT

A printer is provided which includes: a recording head having multiple nozzles; two or more sensors that read a print medium into an image thereof and calculate a total moving distance based on the image; an instruction unit that instructs a timing for discharging liquid droplets from one or more of the nozzles; a sensor position calculator that calculates a position of each of the sensors; a nozzle position calculator that calculates a position of each of the nozzles; an acquisition unit that acquires image data of a specified area within an image to be printed; a determination unit that determines whether or not to discharge the liquid droplets from each of the nozzles; and a transmitter that transmits data of one or more of image elements and information on one or more of the nozzles determined to discharge the liquid droplets to a controller.

8 Claims, 19 Drawing Sheets

| Address | Data |
|---|---|
| SA + 0x0000 | Line 1 |
| SA + 0x0004 | |
| ⋮ | |
| SA + 0x03FF | |
| SA + 0x0400 | Line 2 |
| SA + 0x0404 | |
| ⋮ | |
| SA + 0x07FF | |
| SA + 0x0800 | Line 3 |
| ⋮ | |
| SA + 0x0BFF | |
| SA + 0x0C00 | Line 4 |
| ⋮ | |
| SA + 0x0FFF | |
| ⋮ | ⋮ |
| SA + (N−1)/4*0x1000 + 0x0000 | Line N |
| ⋮ | |
| SA + (N−1)/4*0x1000 + 0x03FF | |

FIG. 18

| CONDITIONS | | RESULTS | | |
|---|---|---|---|---|
| | | | 1 NOZZLE | 1 ROW (192 NOZZLES) |
| MAXIMUM SCANNING SPEED | 400mm/s | 1~DIRECTION DATA | 1.9 bit | 364.8 bit |
| INK DISCHARGE PERIOD (DRIVE PERIOD) | 100 μs | PERIPHERAL (8~DIRECTION) DATA | 15.2 bit | 2918.4 bit |
| DATA GRADATION | 2bit/dot | 600 dpi COORDINATE CONVERSION | 0.95 | 182.4 |
| PRINT RESOLUTION | 600dpi | | | |

PRINTER, PRINTING SYSTEM, AND METHOD OF PRINTING

CROSS-REFERENCE TO RELATED APPLICATIONS

This patent application is based on and claims priority pursuant to 35 U.S.C. §119(a) to Japanese Patent Application No. 2014-189607, filed on Sep. 18, 2014, in the Japan Patent Office, the entire disclosure of which is hereby incorporated by reference herein.

BACKGROUND

1. Technical Field

The present disclosure relates to a printer, a printing system, and a method of printing.

2. Description of the Related Art

In accordance with the rapid spread of smart devices such as compact laptop and smart phone, there is a great demand for portable compact printers. To respond to this demand, hand-held printers without paper conveyance system have been proposed. Hand-held printers are generally configured to apply ink to a plane (e.g., a surface of paper) while scanning the plane freehand.

SUMMARY

In accordance with some embodiments of the present invention, a printer performing printing while being moved on a print medium is provided. The printer includes a recording head, two or more sensors, an instruction unit, a sensor position calculator, a nozzle position calculator, an acquisition unit, a determination unit, and a transmitter. The recording head has a plurality of nozzles that discharge liquid droplets. The two or more sensors each read the print medium into an image of the print medium and calculate a total moving distance based on the image of the print medium. The instruction unit instructs a timing for discharging the liquid droplets from one or more of the nozzles to perform the printing. The sensor position calculator calculates a position of each of the sensors on the print medium relative to a predetermined initial position, based on the total moving distance calculated by each of the two or more sensors. The nozzle position calculator calculates a position of each of the nozzles on the print medium relative to the initial position, based on the positions of the sensors calculated by the sensor position calculator. The acquisition unit acquires image data of a specified area within an image to be printed, based on the position of each of the nozzles calculated by the nozzle position calculator. The determination unit determines whether or not to discharge the liquid droplets from each of the nozzles, based on the position of each of the nozzles calculated by the nozzle position calculator and a position of each of image elements constituting the specified area within the image printed on the print medium according to the image data of the specified area acquired by the acquisition unit. The transmitter transmits data of one or more of the image elements and information on one or more of the nozzles determined to discharge the liquid droplets to a controller that controls discharging of the liquid droplets, based on the timing instructed by the instruction unit and a determination result made by the determination unit.

In accordance with some embodiments of the present invention, a printing system is provided. The printing system includes the above printer and an electronic device that transmits image data to the printer.

In accordance with some embodiments of the present invention, a method of printing by moving on a print medium is provided. The method includes the steps of: reading the print medium by two or more sensors into an image of the print medium; calculating a total moving distance based on the image of the print medium; calculating a position of each of the sensors on the print medium relative to a predetermined initial position, based on the calculated total moving distance; calculating a position of each of a plurality of nozzles on the print medium relative to the initial position, based on the calculated positions of the two or more sensors; acquiring image data of an specified area within an image to be printed based on the position of each of the nozzles; determining whether or not to discharge liquid droplets from each of the nozzles, based on the calculated position of each of the nozzles and a position of each of image elements constituting the specified area within the image printed on the print medium according to the acquired image data of the specified area; instructing a timing for discharging the liquid droplets from one or more of the nozzles to perform the printing; and transmitting data of one or more of the image elements and information on one or more of the nozzles determined to discharge the liquid droplets to a controller that controls discharging of the liquid droplets, based on the timing instructed in the instructing and a determination result made in the determining.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein:

FIG. 18 is a table showing coordinate values proceeding in one drive period;

Figure 1:
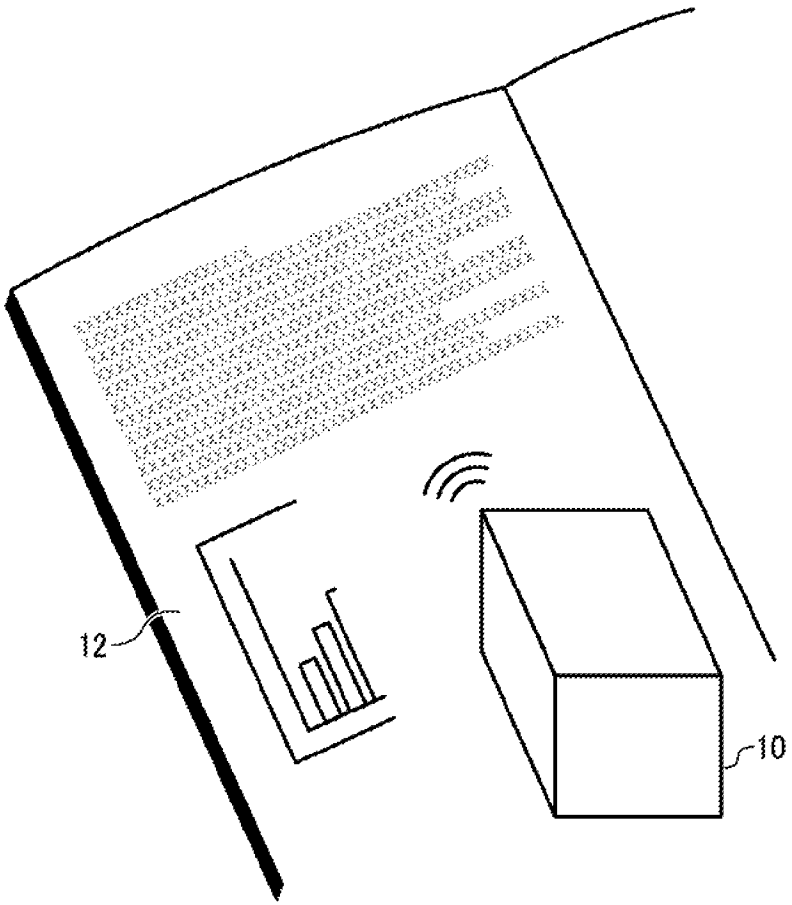
FIG. 1 is a schematic diagram illustrating a printing system including a hand-held printer according to an embodiment of the present invention.
Figure 1:
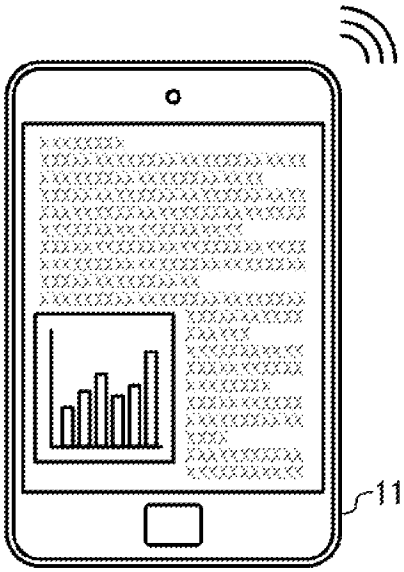

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits, field programmable gate arrays (FPGAs) computers or the like. These terms in general may be referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

In accordance with some embodiments of the present invention, a printer, a printing system, and a printing method are provided which can precisely calculate the positions of nozzles and perform printing control in freehand scanning printing.

FIG. 1 is a schematic diagram illustrating a printing system including a hand-held printer according to an embodiment of the present invention. A hand-held printer 10 has a size and weight that can be carried with one hand. The hand-held printer 10 is freely moved on a print medium 12 to form an image on the print medium 12.

The hand-held printer 10 may be an inkjet-type printer that forms an image on the print medium 12 by discharging liquid droplets of ink or the like from nozzles, but it not limited thereto. Alternatively, the hand-held printer 10 may be a dot-impact-type printer that makes prints by striking a tiny pin against an ink ribbon. The hand-held printer 10 may be either a monochrome printer or a color printer.

The hand-held printer 10 receives image data of a print target and discharges ink or the like on the print medium 12 based on the received image data. The image data may be text data consisting of texts, document data containing graphics, illustration, pictures, etc., table data, or the like. The hand-held printer 10 is capable of receiving print setting information along with the image data and forming an image based on the print setting information. Examples of the print setting information include, but are not limited to, monochrome/color designation.

The hand-held printer 10 receives image data from a smart device 11 serving as a device for holding image data through wireless communication such as infrared communication, Bluetooth (registered trademark), and Wi-Fi. The hand-held printer 10 may receive image data from the smart device 11 either directly or indirectly through access points, etc. The hand-held printer 10 may also receive image data though wire communication by being connected with a cable, etc.

The smart device 11 may be an electronic device such as a smart phone, tablet terminal, and laptop. The smart device 11 performs wireless communication with the hand-held printer 10 to transmit self-holding image data to the hand-held printer 10. The smart device 11 can also transmit image data received from other devices, such as a server, to the hand-held printer 10.

The smart device 11 contains image data, an application for displaying the image data, a memory for storing OS, etc., a CPU for implementing the application, a display for displaying image, and an input device for inputting print instruction for the image. The display and the input device may be either independent from each other or integrally combined into a touch panel.

A user switches on the smart device 11, runs the application, and makes the image data displayed. If the user wishes to print the image data, the user can instruct printing by, for example, tapping a print start button displayed on a touch panel. Upon receipt of the print instruction, the smart device 11 transmits the image data to the hand-held printer 10 through wireless communication.

The hand-held printer 10 receives the image data of the print target from the smart device 11. The user holds the hand-held printer 10 by hand and moves it freely on the print medium 12. At this time, the hand-held printer 10 calculates the position of each nozzle. In particular, the hand-held printer 10 calculates the position of each nozzle as a coordinate position relative to a predetermined initial position. When a coordinate position of image element data (i.e., print data) constituting the received image data coincides with the calculated coordinate position, the hand-held printer 10 then transmits the print data to a control module that controls a recording head. Under the control of the control module, the recording head having multiple nozzles discharges ink from the nozzle positioned at the coordinate position to make a print. The hand-held printer 10 repeats the above-described operation to form an image on the print medium 12.

The hand-held printer 10 is box-shaped as illustrated in FIG. 1 and has multiple nozzles for discharging ink. The hand-held printer 10 is used in such a manner that the surface thereof having the multiple nozzles is pressed against the print medium 12 that is planar. The multiple nozzles are arranged in such a manner that their tips are separated from the print medium 12 when the hand-held printer 10 is pressed against the print medium 12. The distance between the tips of the nozzles and the print medium 12 is preset to a distance enough for making a print by discharging ink from the nozzles. The user makes a print on the print medium 12 by repeating the following operations: pressing the surface of the hand-held printer 10 having the multiple nozzles against the print medium 12, moving the hand-held printer 10 from left to right on the print medium 12, displacing it one level lower, and then moving it from right to left.

Figure 2:
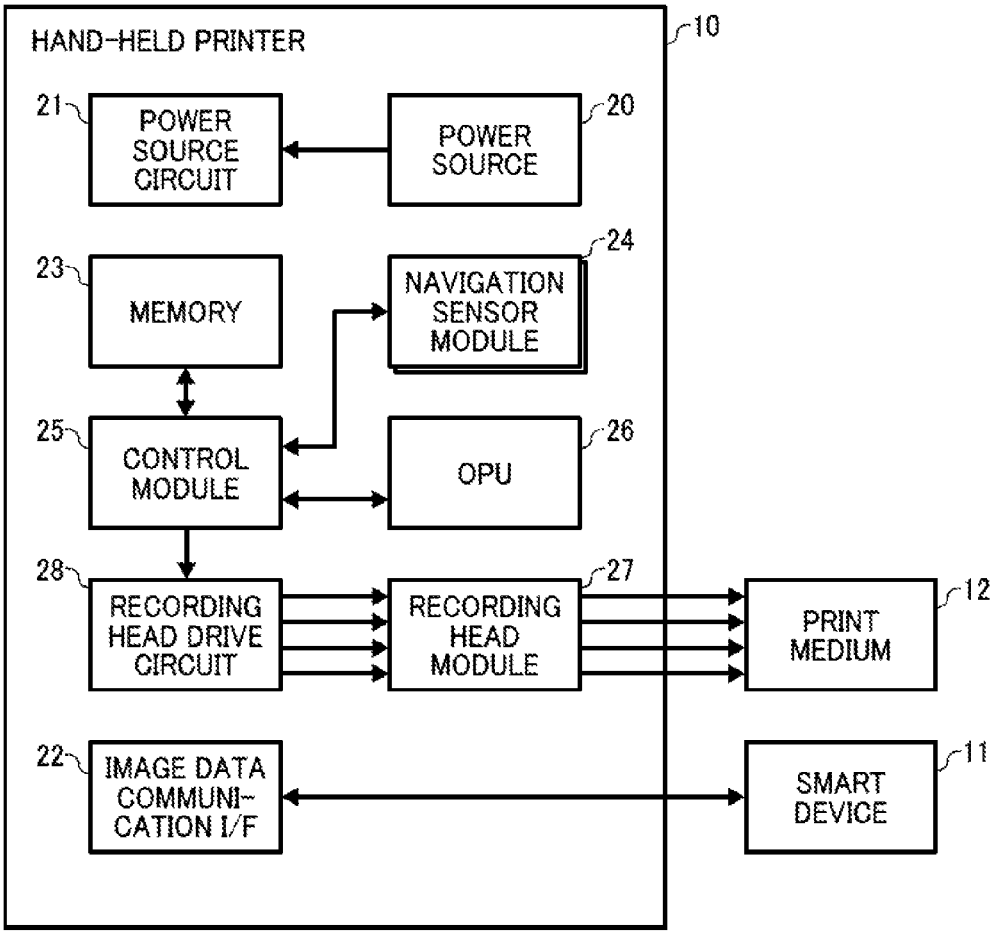
FIG. 2 is a block diagram illustrating a hardware configuration of the hand-held printer.

FIG. 2 is a block diagram of a hardware configuration of the hand-held printer 10. The configuration of the smart device 11 is omitted for the sake of simplicity, since it is equivalent to the configuration of a typical PC or smart phone briefly described above. The hand-held printer 10 includes a power source 20 such as a battery and a power source circuit 21 that controls power to be supplied to each unit. The hand-held printer 10 further includes an image data communication I/F 22 that accepts image data transmitted from the smart device 11.

The hand-held printer 10 further includes a memory 23, two or more navigation sensor modules 24, a control module 25, an operation unit (OPU) 26, a recording head module 27, and a recording head drive circuit 28. The memory 23 stores firmware for controlling hardware of the hand-held printer 10, drive waveform data for driving the recording head, and the like.

The two or more navigation sensor modules 24 detect an initial position of the hand-held printer 10 and output position information on the initial position. The position information is a coordinate information defined on a two-dimensional plane. The position information on the initial position may be represented as, for example, (0,0). The two or more navigation sensor modules 24 also calculate and output moving distances in X-axis and Y-axis directions that are defined as transverse and longitudinal directions relative to the initial position. In other words, the X-axis and Y-axis directions are defined as horizontal and vertical directions relative to the position of the navigation sensor module 24 (hereinafter simply referred to as "sensor" for the sake of convenience) at detecting the initial position. In the case where the multiple nozzles are lined up in a row and the sensors are arranged at the front and rear of the row, the vertical direction relative to the row is defined as the Y-axis direction, and the lateral direction relative to the row (i.e., the vertical direction relative to the Y-axis direction) is defined as the X-axis direction.

The control module 25 may consist of SoC (System on Chip) and ASIC (Application Specific Integrated Circuit), but is not limited thereto. In place of ASIC, FPGA (Field Programmable Gate Alley) may be used that allows a user to set its configuration after production. The control module 25 controls the entire hand-held printer 10. Details of the control are described later. The OPU 26 includes an operation key, a liquid crystal display (LCD), and the like. The OPU 26 may be equipped with a touch panel. The OPU 26 accepts an input from a user and notifies the user of processing status, error, and the like.

The recording head module 27 has a recording head having multiple nozzles for discharging ink. The recording head drive circuit 28 accepts print data for performing printing and print timing information for instructing print timing. The recording head drive circuit 28 drive-controls the recording head to discharge ink onto the print medium 12 based on the print data in accordance with the print timing instructed based on the print timing information.

Upon receipt of a print job (image data) from the smart device 11 by the image data communication I/F 22, the control module 25 calculates the position of each nozzle on the recording head based on information input from the two or more sensors. The received image data is stored in the memory 23. The user holds the hand-held printer 10 by one hand and moves it freely on the print medium 12 to scan the print medium 12. During the scanning, the hand-held printer 10 calculates the position of each nozzle in a continuous manner. The control module 25 acquires an image of a specified area (peripheral area) from the memory 23 in accordance with the calculated position of each nozzle.

The control module 25 compares the acquired peripheral image and the calculated position of each nozzle. When determining that they match with each other with respect to one or more of the nozzles, the control module 25 transmits the print data with respect to the one or more of the nozzles to the recording head drive circuit 28. The recording head drive circuit 28 also accepts the print timing information, drive-controls the recording head, and makes the recording head perform printing.

Figure 3:
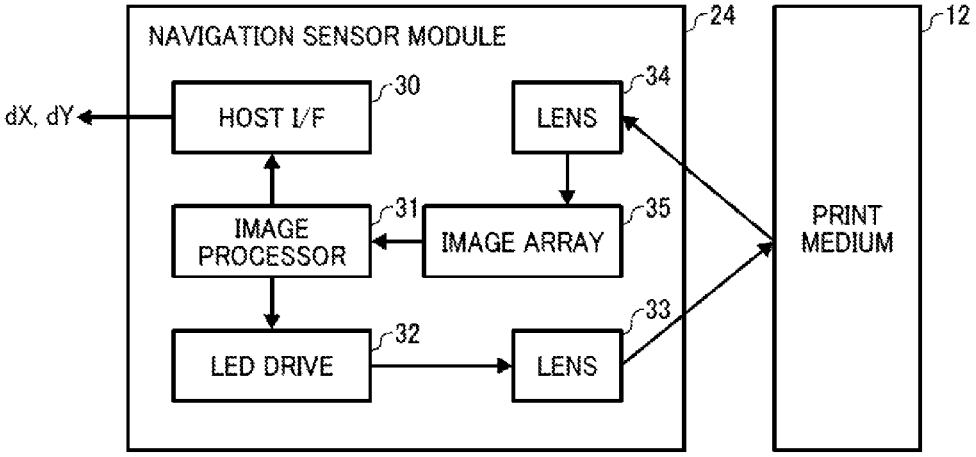
FIG. 3 is a block diagram illustrating a detailed configuration of the navigation sensor in the hand-held printer.

Detailed configuration and function of each module are described below. First, details of the navigation sensor module 24 are explained with reference to FIG. 3. The navigation sensor module 24 includes a host I/F 30, an image processor 31, an LED drive 32, two lenses 33 and 34, and an image array 35. The LED drive 32 controls emission of LED light in such a manner that the LED light is directed to the print medium 12 through the lens 33. The image array 35 receives light reflected from the print medium 12 through the lens 34. The lenses 33 and 34 are arranged so that they optically focus the surface of the print medium 12.

The image array 35 generates image data based on the received light and outputs the image data to the image processor 31. The image processor 31 calculates a moving distance of the navigation sensor module 24 based on the input image data. The calculated moving distance consists of a moving distance dX in the X-axis direction and a moving distance dY in the Y-axis direction. The image processor 31 outputs the calculated moving distance to the control module 25 through the host I/F 30.

In the present embodiment, light emitting diode (LED) is used as the light source. LED is advantageously used in combination with the print medium 12 which has a rough surface, such as paper. This is because the rough surface generally generates shades, and the shades can behave as characterizing portions in precisely calculating the moving distances in the X-axis and Y-axis directions. On the other hand, in the case where the print medium 12 has a smooth surface or is transparent, laser diode (LD) that emits laser light can be used as the light source. For example, by forming striped patterns or the like as characterizing portions on the print medium 12 by LD, the moving distances can be precisely calculated based on the characterizing portions.

Figure 4A:
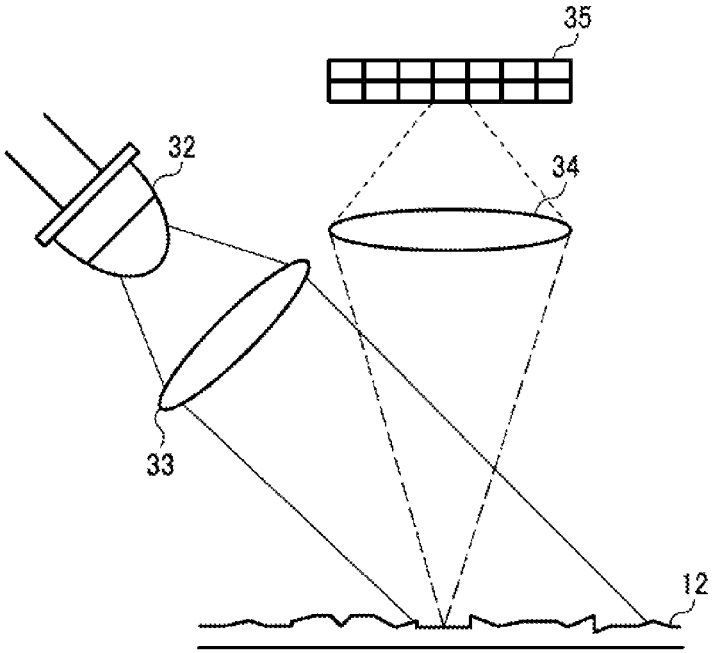
FIGS. 4A and 4B are schematic diagrams for explaining functions of the navigation sensor in the hand-held printer.

Next, function of the navigation sensor module 24 is explained with reference to FIGS. 4A and 4B. The navigation sensor module 24 includes the LED drive 32, the lenses 33 and 34, and the image array 35, as illustrated in FIG. 4A. Light emitted from the LED drive 32 is directed to the surface of the print medium 12 through the lens 33. A magnified view of the print medium 12 shows that the surface thereof has irregularities in various shapes, as illustrated in FIG. 4A. These irregularities generate shades in various shapes.

The image processor 31 receives reflected light through the lens 34 and the image array 35 at every predetermined sampling timing to generate image data. The image processor 31 forms the image data into a matrix at specified resolution units. In particular, the image processor 31 divides the image into multiple rectangular areas. The image processor 31 compares the image obtained at the previous sampling timing with the image obtained at the present sampling timing to detect a difference therebetween, and calculates the moving distance based on the difference.

Figure 4B:
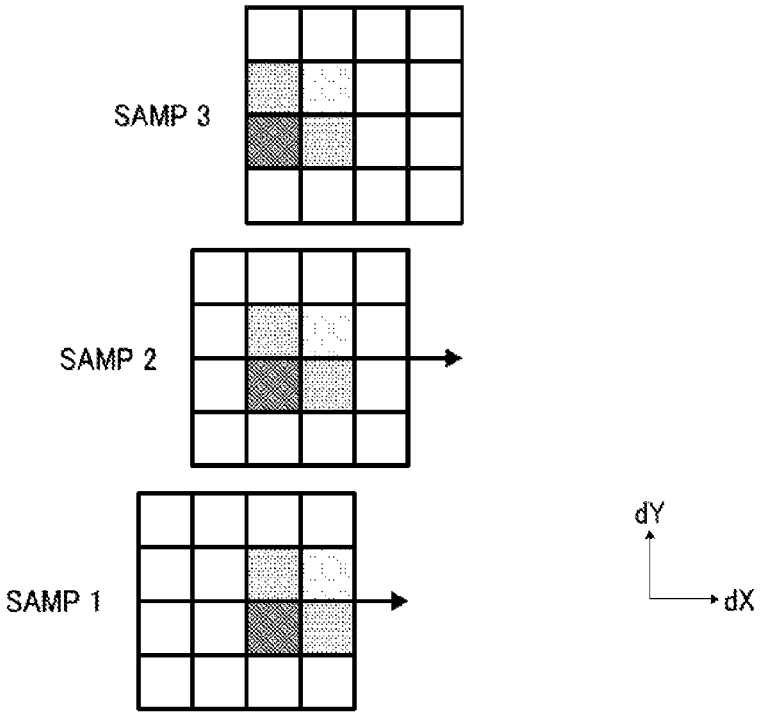

Samp 1, Samp 2, and Samp 3 illustrated in FIG. 4B are images obtained at each sampling timing in this order. FIG. 4B indicates that the characterizing portion formed of four rectangular areas with black and gray shades shifts from right to left by one resolution unit. In the case where Samp 1 is a reference, in Samp 2, the characterizing portion has shifted in the X-axis direction by one resolution unit. Therefore, the output value (dX, dY) becomes (1,0). In the case where Samp 2 is a reference, in Samp 3, the characterizing portion has shifted in the X-axis direction by one resolution unit. Therefore, the output value (dX, dY) becomes (1,0), either.

The sensor outputs dX and dY that respectively represent the moving distances in the X-axis and Y-axis directions relative to the direction of the sensor itself. Accordingly, even when a user rotates the hand-held printer 10 to a left or right direction on the print medium 12 and thereby rotating the navigation sensor module 24, the rotation component cannot be detected. The unit for the moving distance depends on the device in use. Assuming a printer, a resolution of about 1,200 dpi is required.

Figure 5:
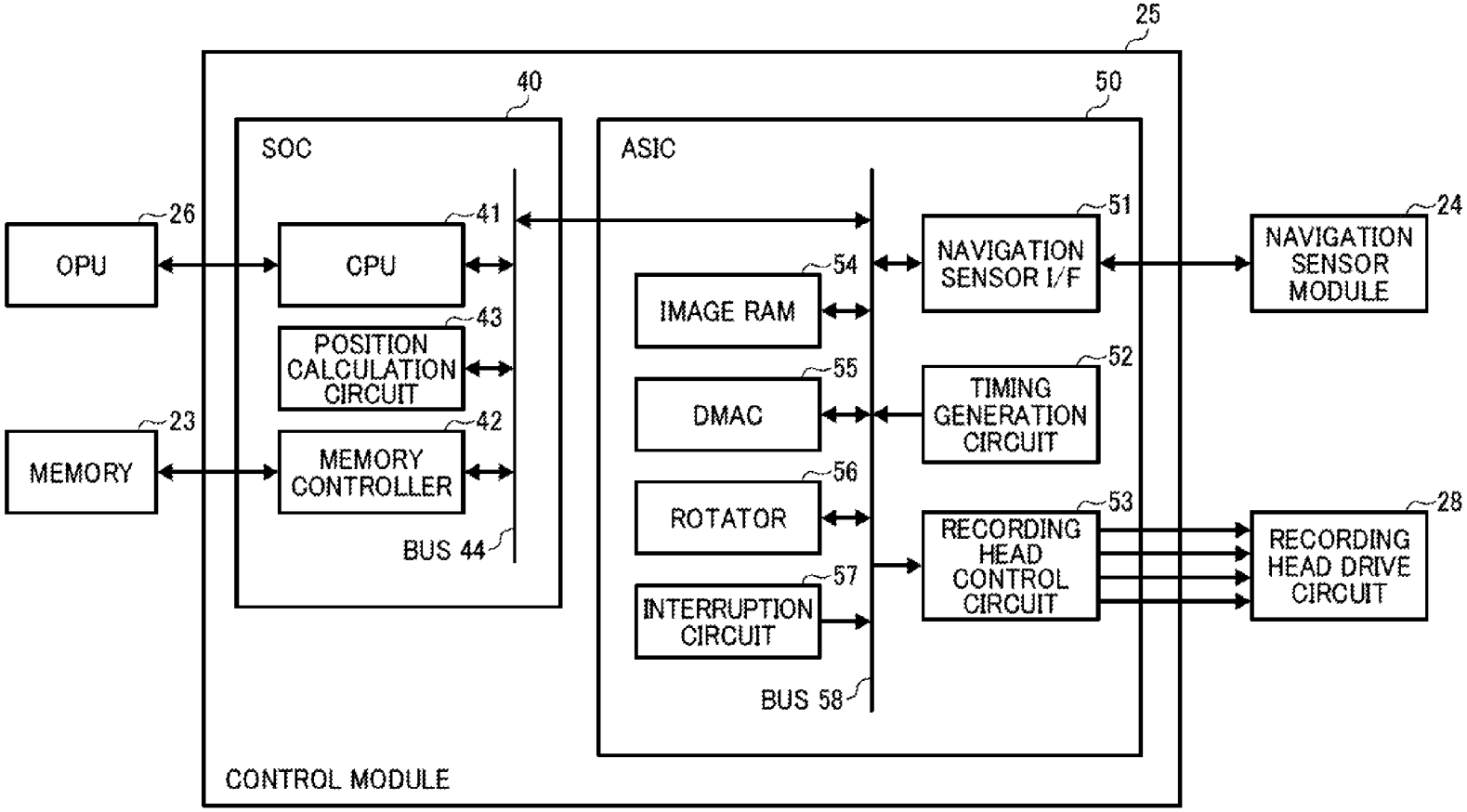
FIG. 5 is a block diagram illustrating a detailed configuration of the control module in the hand-held printer.

Detailed configuration and function of the control module 25 are explained with reference to FIG. 5. The control module 25 includes SoC 40 and ASIC 50. The SoC 40 includes a CPU 41 that controls the entire hand-held printer 10, a memory controller (CTL) 42 that controls the memory 23, and a position calculation circuit 43 that calculates a position of the sensor or each nozzle. These components are connected to a bus 44, and exchange data and the like thereamong through the bus 44.

The ASIC 50 includes a navigation sensor I/F 51, a timing generation circuit 52, a recording head control circuit 53, an image RAM 54, a DMAC (Direct Memory Access Controller) 55, a rotator 56, and an interruption circuit 57. These components are connected to a bus 58, and exchange data and the like thereamong through the bus 58. The bus 58 is connected to the bus 44. The SoC 40 and the ASIC 50 exchange data and the like therebetween through the buses 44 and 58.

The navigation sensor I/F 51 communicates with the sensor to receive the values dX and dY output from the sensor and stores the values in an internal register that is an internal memory. The timing generation circuit 52 generates information on a timing for obtaining image data that is in the form of light emitted from the sensor and reflected from the print medium 12, and notifies the navigation sensor I/F 51 of the information. In particular, the timing generation circuit 52 instructs a timing for reading the print medium 12. The timing generation circuit 52 further generates information on a timing for driving the recording head and notifies the recording head control circuit 53 of the information. In particular, the timing generation circuit 52 instructs a timing for discharging ink from the multiple nozzles to perform printing.

The DMAC 55 reads out image data of a peripheral image of each nozzle on the recording head from the memory 23 based on the position information calculated by the position calculation circuit 43. The image RAM 54 temporarily stores the image data of the peripheral image read out by the DMAC 55. The rotator 56 rotates the peripheral image in accordance with the position or inclination of the head specified by a user and outputs the rotated peripheral image to the recording head control circuit 53. For example, the rotator 56 can rotate the peripheral image based on a rotation angle which can be calculated when the position calculation circuit 43 calculates a position coordinate.

The recording head control circuit 53 generates a control signal based on the information on the timing for driving the recording head, accepts the image data of the peripheral image output from the rotator 56, and determines which nozzles to discharge ink. The recording head control circuit 53 outputs information on the nozzles to discharge ink and print data to the recording head drive circuit 28 in accordance with the determination result and information on timing.

Upon termination of the communication between the navigation sensor I/F 51 and the navigation sensor module 24, the interruption circuit 57 notifies the SoC 40 of the communication termination and status information such as error.

Figure 6:
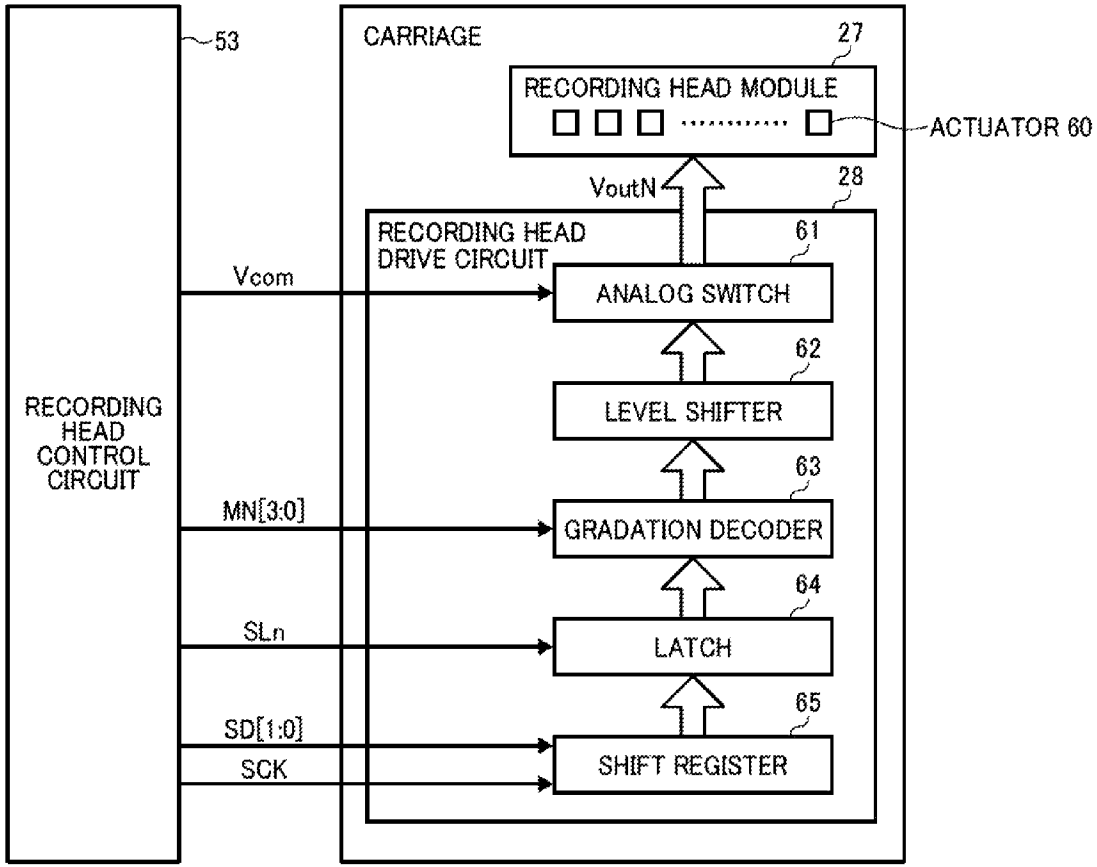
FIG. 6 is a block diagram illustrating detailed configurations of the recording head module and the recording head driving circuit in the hand-held printer.

Detailed configurations and functions of the recording head module 27 and the recording head drive circuit 28 are explained with reference to FIGS. 6 and 7. The configurations of the recording head module 27 and the recording head drive circuit 28 illustrated in FIG. 6 are typical configurations for inkjet printers. The recording head module 27 has multiple nozzles each having an actuator 60. The actuator 60 may be of either thermal or piezo type. An actuator of thermal type makes ink droplets be discharged from nozzles by heating ink within the nozzles to expand. An actuator of piezo type makes ink droplets be discharged from nozzles by pushing the walls of the nozzles by a piezoelectric element to push out ink from the nozzles.

The recording head drive circuit 28 includes an analog switch 61, a level shifter 62, a gradation decoder 63, a latch 64, and a shift register 65. The recording head control circuit 53 transfers image data SD that is serial data corresponding to the number of the nozzles on the recording head (equivalent to the number of the actuators 60) to the shift register 65 within the recording head drive circuit 28 according to an image data transfer clock SCK. Upon completion of the transfer, the recording head control circuit 53 causes the latch 64 provided for every nozzle to memorize the image data SD according to an image data latch signal SLn.

After latching of the image data SD, the recording head control circuit 53 outputs a head drive waveform Vcom that causes each nozzle to discharge ink droplets in accordance with each gradation value to the analog switch 61. At this time, the recording head control circuit 53 gives a head drive mask pattern MN as a gradation control signal to the gradation decoder 63 while making the head drive mask pattern MN transit to be selected in accordance with the timing of the drive waveform. The gradation decoder 63 performs a logical operation of the gradation control signal MN and the latched image data. The level shifter 62 boosts a logical level voltage signal obtained by the logical operation to a voltage that can drive the analog switch 61.

As the analog switch 61 accepts the boosted voltage signal and switches ON/OFF, a drive waveform VoutN supplied to the actuator 60 in the recording head becomes different in waveform among the nozzles. The recording head discharges ink droplets based on the drive waveform to form an image on the print medium 12.

Figure 7:
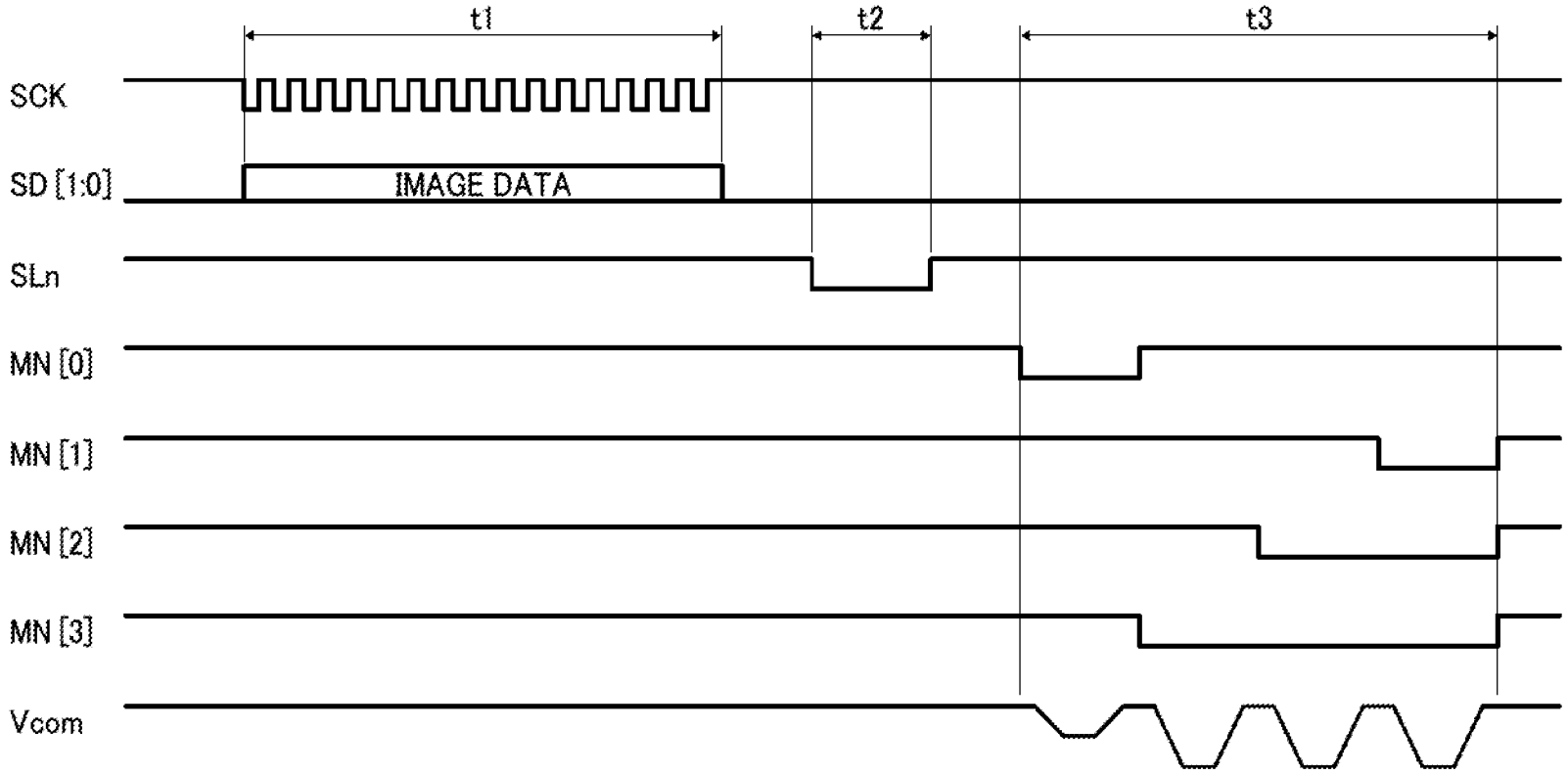
FIG. 7 is a timing diagram for drive control of the recording head in the hand-held printer.

Drive control of the recording head is performed according to a timing diagram illustrated in FIG. 7. In particular, according to the image data transfer clock SCK, the image data SD is transferred to each nozzle within a time period t1. After the transfer, the image data SD is latched for each nozzle within a time period t2. After the latch, the gradation control signal MN and the head drive waveform Vcom are input within a time period t3 and subjected to the above-described operation so that ink is discharged based on the image data. In FIG. 7, four gradation control signals MN[0], MN[1], MN[2], and MN[3] are input to the gradation decoder 63.

Figure 8:
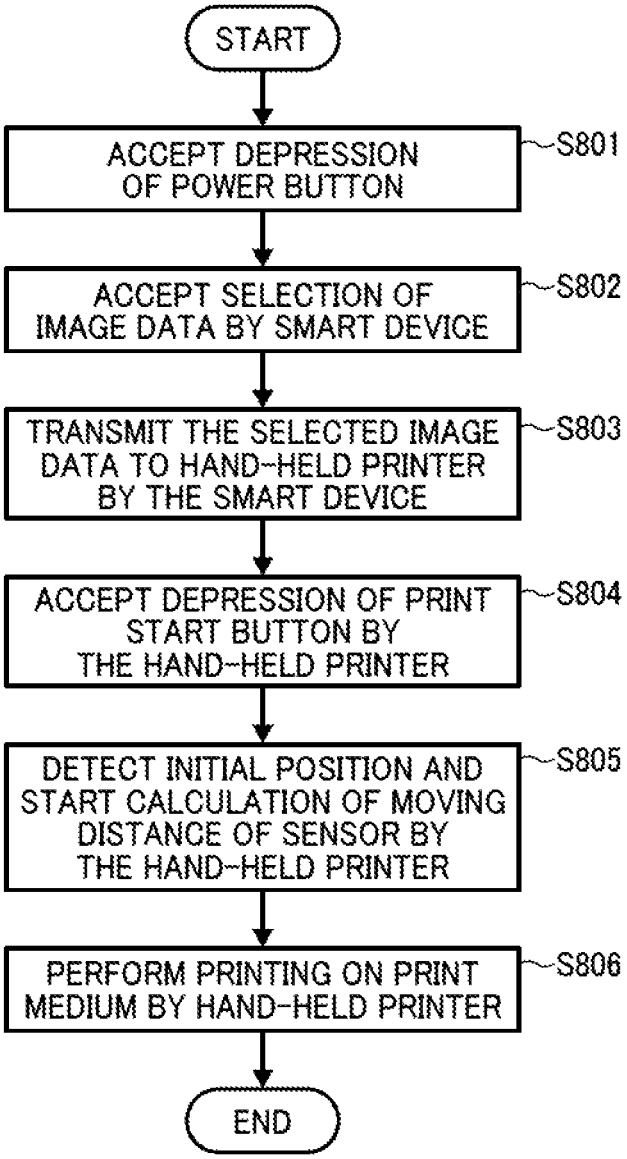
FIG. 8 is a flowchart illustrating a detailed operation executed by the printing system.

Hardware configuration and function of the hand-held printer 10 in the printing system have been described above. Processing executed by the printing system is described below with reference to FIG. 8. As a processing starts, in step 801, a user depresses a power button of the smart device 11, the smart device 11 accepts the depression of the power button, and power is supplied from a power source, etc., to start up the smart device 11. The hand-held printer 10 is also switched on. In step 802, the user selects an image to be printed on the smart device 11, and the smart device 11 accepts the selection of the image. In step 803, the user instructs printing of the selected image, and the smart device 11 requests the hand-held printer 10 to execute a print job. The image data is transmitted to the hand-held printer according to the request.

The user holds the hand-held printer 10, determines its initial position on a print medium such as a notebook, and depresses a print start button of the hand-held printer 10. In step 804, the hand-held printer 10 accepts the depression of the print start button. In step 805, the hand-held printer 10 immediately detects the initial position and starts calculation of the moving distance of the sensor. In step 806, the hand-held printer 10 that is freely moved by the user detects the position of the sensor, determines a position of each nozzle based on the position of the sensor, and compares the position of each nozzle with a position coordinate of image data so as to determine whether to discharge ink or not from the nozzle. The hand-held printer 10 transmits print data so as to discharge ink from the nozzle determined to discharge ink, thereby performing printing on the print medium 12. Upon completion of the printing on the print medium 12, the processing ends.

Figure 9:
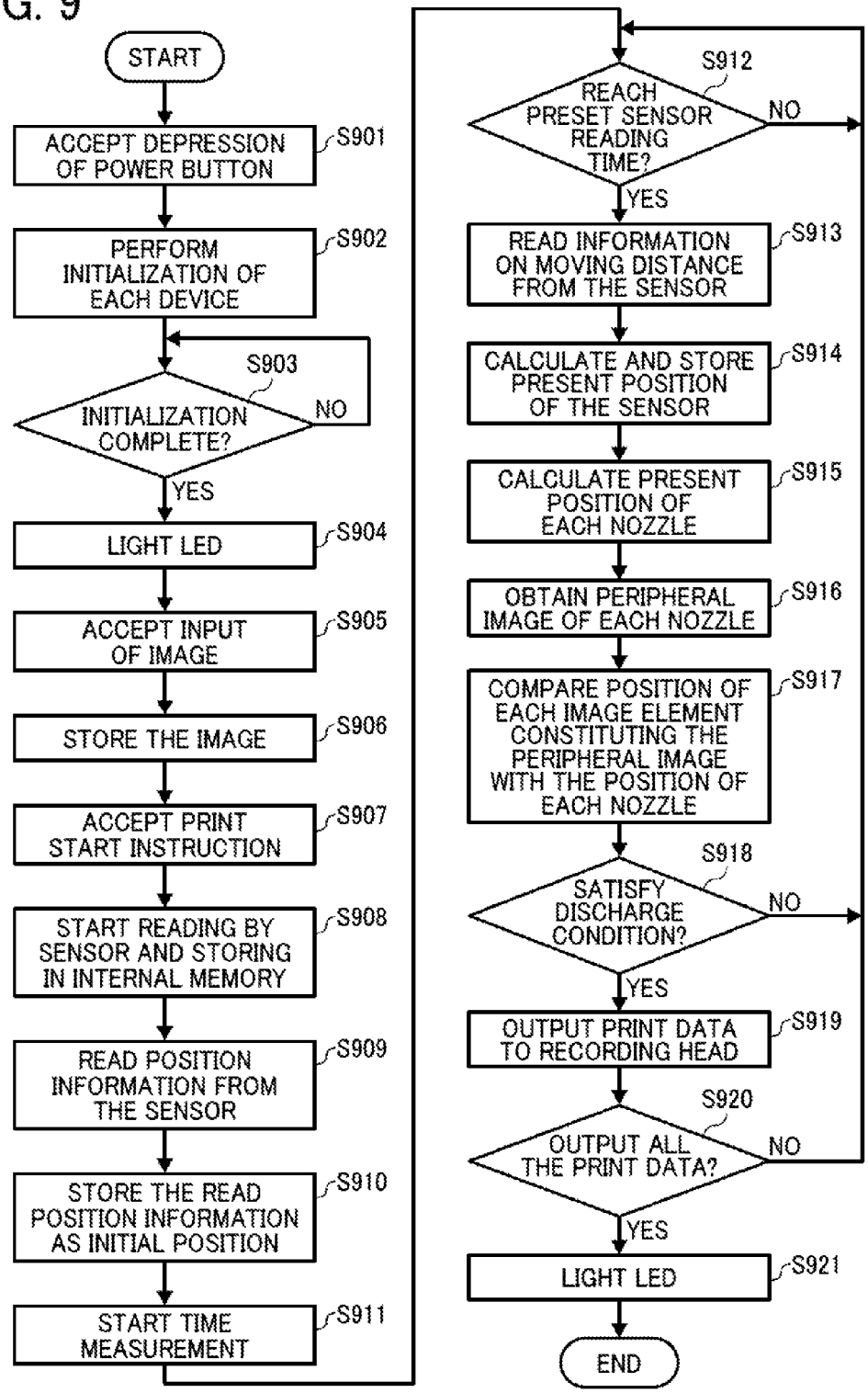
FIG. 9 is a flowchart illustrating a detailed operation executed by the hand-held printer.

Detailed processing executed by the hand-held printer 10 is described below with reference to FIG. 9. As a processing starts, in step 901, the hand-held printer 10 accepts depression of a power button, and power is supplied from a power source, etc., to start up the hand-held printer 10.

In step 902, the hand-held printer 10 starts up its built-in devices including the sensor and performs initialization thereof. In the initialization, various setting values are set to allow a user to instruct printing. In addition, a communication is established between the hand-held printer 10 and the smart device 11. In step 903, whether the initialization is completed or not is determined. When it is determined that the initialization has not been completed, this determination is repeated. When it is determined that the initialization has been completed, the processing proceeds to step 904. In step 904, the user is notified that the hand-held printer 10 is ready to perform printing by, for example, lighting of LED.

In step 905, the hand-held printer 10 accepts input of image data from the smart device 11 and notifies the user of the input of the image data by, for example, lighting of LED. In step 906, the input image data is stored in the memory 23. In step 907, the hand-held printer 10 accepts a print start instruction. In step 908, the hand-held printer 10 starts reading by the sensor and storing in an internal memory.

In step 909, the navigation sensor I/F 51 in the ASIC 50 is notified to make the SoC read position information of the sensor. The navigation sensor I/F 51 communicates with the sensor and reads the position information stored in the sensor. In step 910, the SoC 40 stores the read position information as an initial position represented by, for example, a coordinate (0,0).

In step 911, the timing generation circuit 52 in the ASIC 50 starts time measurement. In step 912, whether it reaches the preset sensor reading timing or not is determined. When it is determined that it has reached the sensor reading timing, the processing proceeds to step 913. In step 913, the navigation sensor I/F 51 reads information on the moving distance stored in the internal memory of the sensor. The sensor reading timing may be preset so as to coincide with the drive period of the recording head.

In step 914, the SoC 40 reads the information on the moving distance from the ASIC 50, and the position calculation circuit 43 calculates the present position based on the previously-calculated position (X, Y) and the presently-read moving distance (dX, dY) and stores it. In the case where no previously-calculated position exists, the present position is calculated based on the initial position and the presently-read moving distance. A method of calculating the present position is described later.

In step 915, the SoC 40 notifies the ASIC 50 of information on the calculated present position of the sensor. The ASIC 50 calculates a position coordinate of each nozzle based on a predetermined assembling positional relation between the sensor and each nozzle on the recording head. A method of calculating the position coordinate of each nozzle is also described later. In step 916, the rotator 56 reads out image data of a peripheral image of each nozzle from the memory 23 to the image RAM 54 based on information on the calculated position of each nozzle. The rotator 56 rotates the image in accordance with the position or inclination of the head specified by a user. Details of image data of and position information on the peripheral image are described later.

In step 917, the ASIC 50 compares a position coordinate of each image element constituting the rotated peripheral image with the position coordinate of each nozzle. In step 918, whether a preset ink discharge condition is satisfied or not is determined. The discharge condition may include, for example, a condition where the position coordinate of an image element coincides with that of a nozzle. When it is determined that the discharge condition is not satisfied, the processing goes back to step 912. When it is determined that the discharge condition is satisfied, the processing proceeds to step 919. In step 919, print data of image elements satisfying the discharge condition are output to the recording head control circuit 53 to cause the recording head to discharge ink. Details of the discharge condition, determination operation thereof, and recording head control operation are described later.

In step 920, whether all the print data are output or not is determined. When it is determined that not all the print data have been output, a series of processing through steps 912 to 919 is repeated. When it is determined that all the print data have been output, the processing proceeds to step 921. In step 921, the user is notified of completion of the printing by, for example, lighting of LED. Even when not all the print data have been output, it can be determined that the printing is completed if the user depresses a print end button according to his/her decision and the SoC 40 accepts it. After the notification to the user, the printing performed by the hand-held printer 10 ends. The hand-held printer 10 may be switched off either manually by the user after completion of the printing or automatically upon completion of the printing.

In the present embodiment, the SoC 40 and the ASIC 50 share the processing. Depending on the performance of the CPU 41, the circuit scale of the ASIC 50, or the like, division of roles between them is arbitrary.

Figure 10:
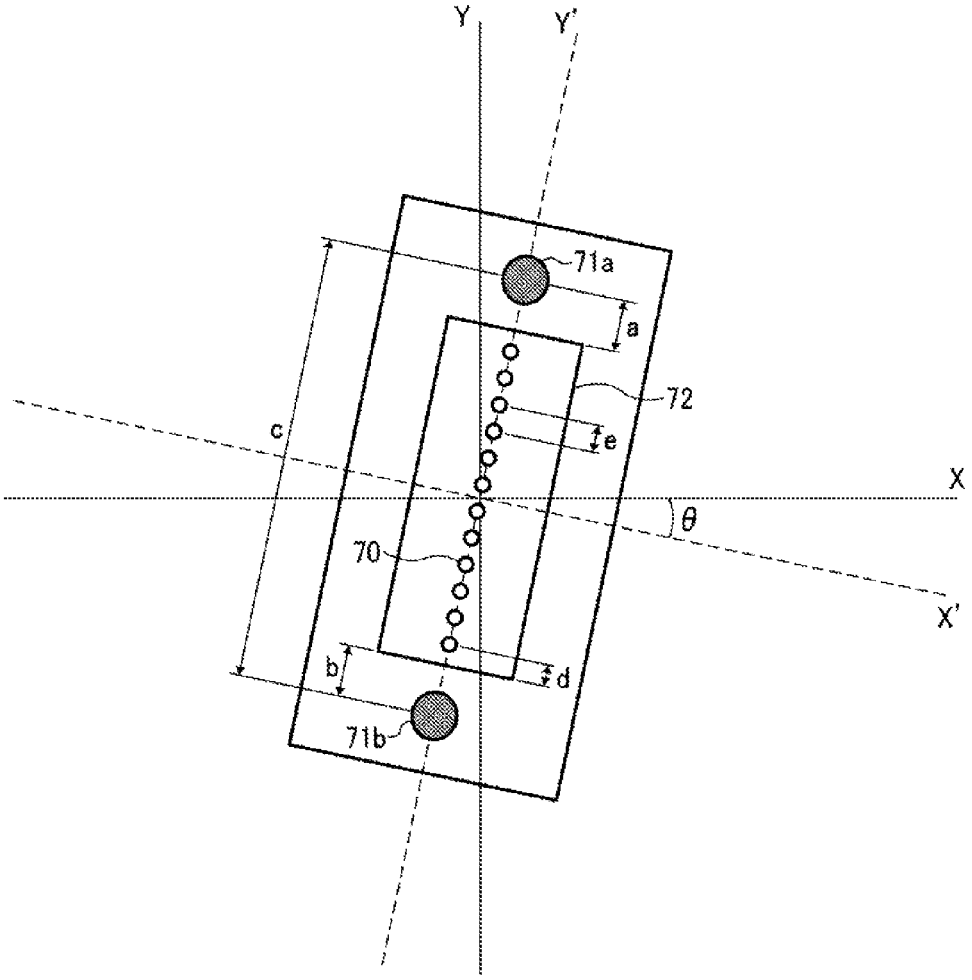
FIG. 10 is a schematic diagram illustrating a positional relation between the navigation sensor and nozzles provided on a recording head.

The predetermined assembling positional relation between the sensor and each nozzle on the recording head is described below with reference to FIG. 10. At least two sensors are provided. In particular, as illustrated in FIG. 10, at least one sensor is provided at each of the front and rear of a row of nozzles 70 arranged in line at regular intervals. A symbol c represents a distance between sensors 71*a* and 71*b*. The distance c is preferably as long as possible. This is because operation errors possibly generated in calculating the positions of the sensors 71*a* and 71*b* become smaller.

In FIG. 10, the two sensors 71*a* and 71*b* are provided. A symbol a represents a distance between the center of the sensor 71*a* and one end of a recording head 72. A symbol b represents a distance between the center of the sensor 71*b* and the other end of the recording head 72. A symbol d represents a distance between one end of the recording head 72 and the nozzle 70 closest to the end. A symbol e represents a distance between two of the nozzles 70 adjacent to each other. The distances a to e are each predetermined. Therefore, a position coordinate of each nozzle 70 can be calculated by calculating the position coordinates of the sensors 71*a* and 71*b*.

The transverse and longitudinal directions with respect to the print medium 12 are defined as X-axis and Y-axis, respectively. The output axes of the sensors 71*a* and 71*b* are defined in the same manner. When the hand-held printer 10 is inclined at an angle θ by a user during scanning, as illustrated in FIG. 10, the values output from the sensors 71*a* and 71*b* are based on X'-axis and Y'-axis that are respectively inclined at an angle θ from the X-axis and Y-axis. Thus, the values output from the sensors 71*a* and 71*b* represent moving distances in the lateral and horizontal directions based on the X'-axis and Y'-axis, not moving distances in the lateral and horizontal directions based on the X-axis and Y-axis with respect to the print medium 12. Even in such a case, by sequentially calculating a position coordinate based on the X-axis and Y-axis with respect to a print medium 12 using the obtained moving distances and by storing the calculated position coordinate, it is possible to grasp a normal coordinate position.

Figure 11:
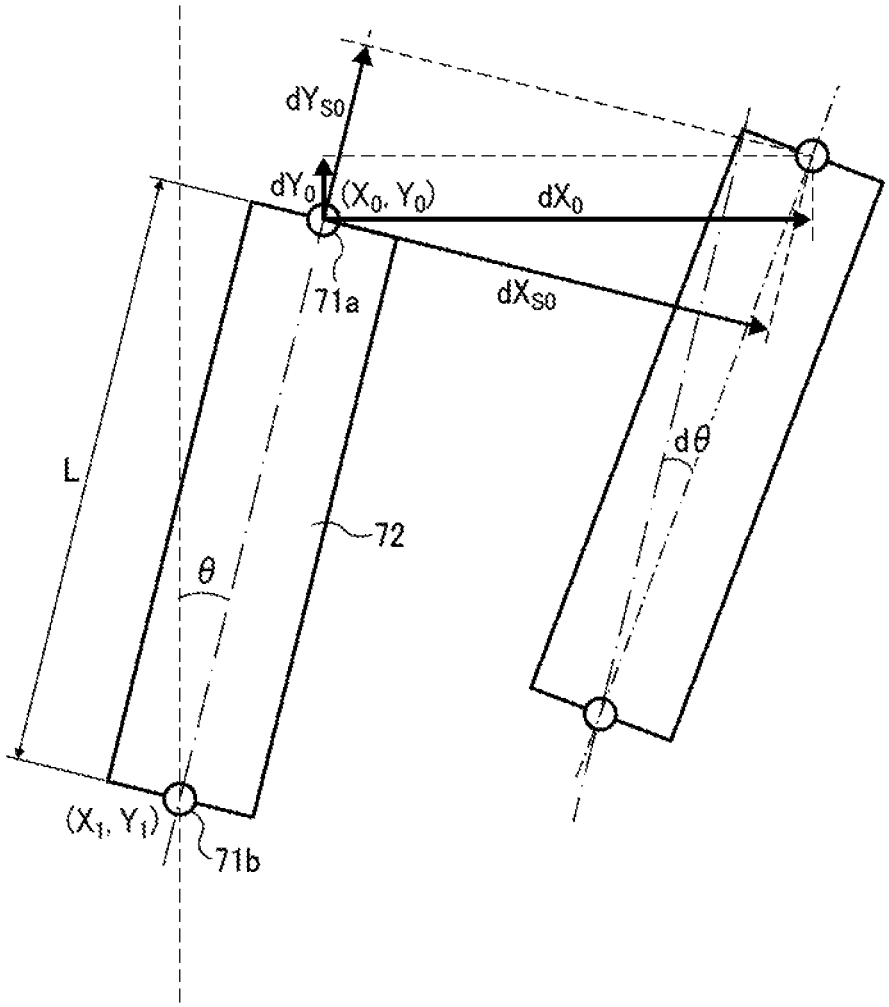
FIG. 11 is a schematic diagram for explaining a method of calculating the position of the navigation sensor.

A method of calculating the position coordinates of the sensors 71*a* and 71*b* is described below with reference to FIG. 11. FIG. 11 illustrates a case where the hand-held printer 10 is inclined at an angle θ relative to the X-axis and Y-axis with respect to the print medium 12, and further inclined at an angle dθ during the scanning. The hand-held printer illustrated on the left represents that before the scanning, and the hand-held printer 10 illustrated on the right represents that after the scanning.

Pre-scanning position coordinates of the two sensors 71*a* and 71*b* are represented by $(X_0, Y_0)$ and $(X_1, Y_1)$, respectively. A distance between the two sensors 71*a* and 71*b* is represented by L. Moving distances of the sensor 71*a* in the X-axis and Y-axis directions from the pre-scanning position coordinate $(X_0, Y_0)$ to a post-scanning position coordinate are represented by $dX_0$ and $dY_0$, respectively. Moving distances of the sensor 71*a* in the X'-axis and Y'-axis directions that are inclined at an angle θ are represented by $dX_{S0}$ and $dY_{S0}$, respectively. Moving distances of the sensor 71*b* in the X'-axis and Y'-axis directions that are inclined at an angle θ are represented by $dX_{S1}$ and $dY_{S1}$, respectively.

In calculating position coordinates, a total movement distance is divided into a rotary movement component and parallel movement components. The rotary movement component is calculated from the following formula (1) based on a difference between the sensor 71*a* and the sensor 71*a* in the X'-axis direction.

$$d\theta = \tan^{-1}\left(\frac{(dX_{S0} - dX_{S1})}{L}\right) \quad \text{Formula (1)}$$

The parallel movement components are calculated as the moving distances $dX_0$ and $dY_0$ of the sensor 71*a* from the following formula (2) using trigonometric functions. In the formula (2), the inclination angle θ of the hand-held printer 10 relative to the print medium 12 is maintained.

$$dX_0 = dX_{S0} \times \cos\theta + dy_{S0} \times \sin\theta$$

$$dY_0 = -dX_{S0} \times \sin\theta + dY_{S0} \times \cos\theta \quad \text{Formula (2)}$$

Thus, the post-scanning position coordinate of the sensor 71*a* can be represented as $(X_0+dX_0, Y_0+dY_0)$. The post-scanning position coordinate thus calculated is then redefined as $(X_0, Y_0)$, and a next post-scanning position coordinate is calculated in the same manner. On the other hand, a post-scanning position coordinate $(X_1, Y_1)$ of the sensor 71*b* is calculated from the following formula (3). It is to be noted that both of the pre-scanning and post-scanning position coordinates of the sensor 71*b* are represented by $(X_1, Y_1)$ since the post-scanning position coordinate of the sensor 71*a* is immediately redefined as $(X_0, Y_0)$ for calculating a next post-scanning position coordinate.

$$X_1 = X_0 - L \times \sin(\theta + d\theta)$$

$$Y_1 = Y_0 - L \times \cos(\theta + d\theta) \quad \text{Formula (3)}$$

The above-described method of calculating position coordinates is an example which uses trigonometric functions. In calculating the moving distances of the sensors 71*a* and 71*b* and the position coordinate of each nozzle on the recording head, the angle dθ is negligibly small. For example, in the case where the distance L is 1 inch, the scanning is performed at a high speed of 400 mm/s, and its sampling cycle is 100 μs, the movable distance is about 40 μm and the rotatable angle dθ is about 0.0015 in one sampling period. In such a case where an inequality dθ<<1 is satisfied, an equality dθ=sin dθ=tan dθ is satisfied. Accordingly, the formula 2 can be rewritten into the following formula 4 using the formula 1 and addition theorem.

$$X_1 = X_0 - L \times \left\{ \sin\theta \times \sqrt{\left(1 - \left(\frac{dX_{S0} - dX_{S1}}{L}\right)^2\right)} + \cos\theta \times \left(\frac{dX_{S0} - dX_{S1}}{L}\right) \right\} \quad \text{Formula (4)}$$

$$Y_1 = Y_0 - L \times \left\{ \cos\theta \times \sqrt{\left(1 - \left(\frac{dX_{S0} - dX_{S1}}{L}\right)^2\right)} - \sin\theta \times \left(\frac{dX_{S0} - dX_{S1}}{L}\right) \right\}$$

The formula 4 makes it possible to calculate the position coordinate only from sin θ and cos θ without calculating sin(θ+dθ) and cos(θ+dθ) using dθ that represents a rotation amount before and after the scanning. Thus, it is possible to directly manage sin θ and cos θ. This arithmetic operation requires the angle dθ be negligibly small. The arithmetic operation also and needs to be continuously performed at every sampling period since the position coordinate is calculated from the previously-calculated position coordinate and the moving distance therefrom. By performing the calculation of the position coordinate in every sampling period, it becomes possible to successively grasp two-dimensional coordinates of the two sensors 71*a* and 71*b* with respect to the print medium 12.

Figure 12:
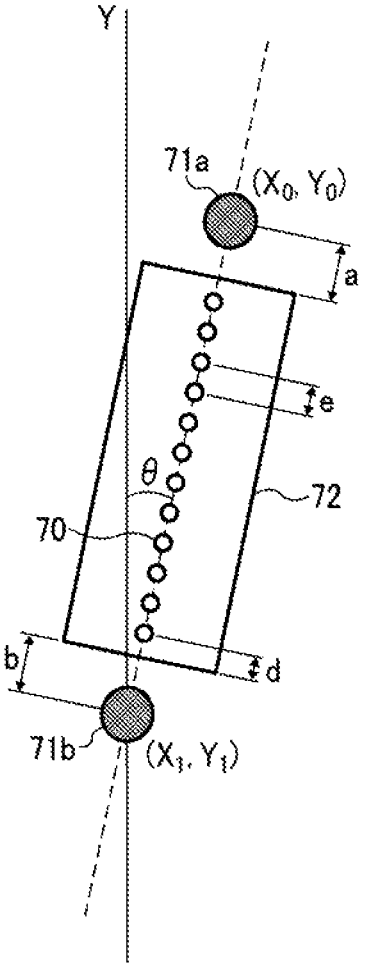
FIG. 12 is a schematic diagram for explaining a method of calculating the position of each of the nozzles when arranged in one row.
Figure 13:
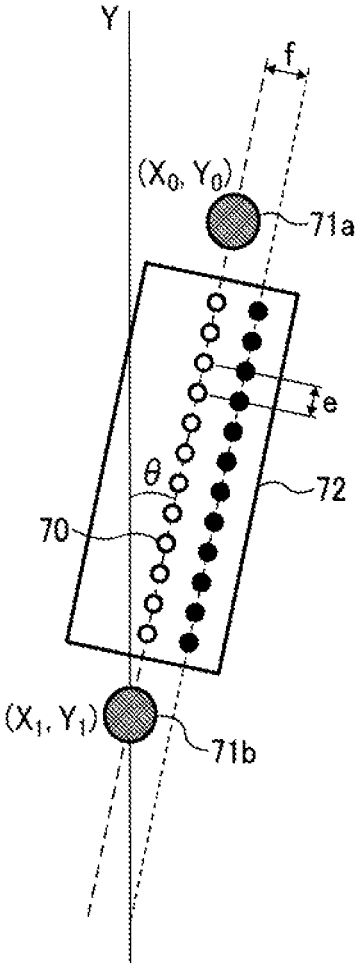
FIG. 13 is a schematic diagram for explaining a method of calculating the position of each of the nozzles when arranged in two rows.

A method of calculating the position coordinate of each of the nozzles 70 is described below with reference to FIG. 12. As described above, the symbol a represents a distance between the center of the sensor 71*a* and one end of the recording head 72. The symbol b represents a distance between the center of the sensor 71*b* and the other end of the recording head 72. The symbol d represents a distance between one end of the recording head 72 and the nozzle 70 closest to the end. The symbol e represents a distance between two of the nozzles 70 adjacent to each other. The distances a to e are each predetermined. The position coordinate of the sensors 71*a* and 71*b* are represented as $(X_0, Y_0)$ and $(X_1, Y_1)$, respectively.

Coordinate positions $NZL_{N_}X$ and $NZL_{N_}Y$ of the nozzles 70 are calculated from the following formula (5). In the formula (5), N represents the arrangement order of the nozzle 70 from the sensor 71*a* side.

$$NZL_{N_}X = X_0 - (a + d + (N-1) \times e) \times \sin\theta$$

$$NZL_{N_}Y = Y_0 - (a + d + (N-1) \times e) \times \cos\theta \quad \text{Formula (5)}$$

The recording head is not limited to that including only one row of the nozzles 70. For the purpose of color printing, the recording head may include two or more rows of the nozzles 70. The position coordinates of the nozzles 70 arranged on the straight line connecting the sensors 71*a* and 71*b* are calculated from the formula (5). On the other hand, coordinate positions $NZL_{C\text{-}N_}X$ and $NZL_{C\text{-}N_}Y$ of the nozzles 70 which are not arranged on the straight line connecting the sensors 71*a* and 71*b* are calculated from the following formula (6) using a distance f between the nozzle rows.

$$NZL_{C\text{-}N_}X = X_0 - (a + d + (N-1) \times e) \times \sin\theta + f \times \cos\theta$$

$$NZL_{C\text{-}N_}Y = Y_0 - (a + d + (N-1) \times e) \times \cos\theta + f \times \sin\theta \quad \text{Formula (6)}$$

Figure 14:
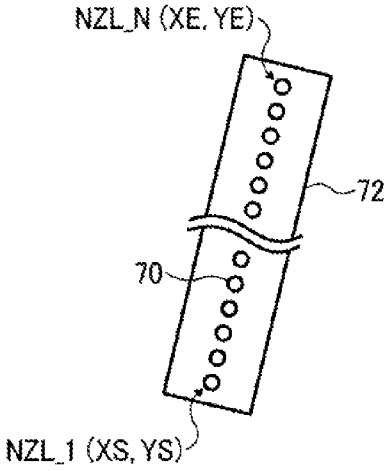
FIG. 14 is a schematic diagram for explaining a method of calculating the position of each of the nozzles in a simple manner.

The position coordinates of the nozzles 70 can be calculated from the formulae (5) and (6) using trigonometric functions. However, such operations using trigonometric functions are time-consuming. As illustrated in FIG. 14, the distance e between adjacent nozzles is equal among those for all possible pairs of adjacent nozzles. A position coordinate $(NZL_{NX}, NZL_{NY})$ of each one of the nozzles 70 is calculated by a simple proportional arithmetic operation represented by the following formula (7), where (XS, YS) and (XE, YE) represent position coordinates of the foremost nozzle 70 and the rearmost nozzle 70, respectively. In addition, in the formula (7), E represents the total number of the nozzles 70 and N represents the arrangement order of each one of the nozzles 70 from the foremost nozzle 70 to the rearmost nozzle 70.

$$NZL_{NX} = XS + \frac{XE - XS}{E - 1} \times N \quad \text{Formula (7)}$$

$$NZL_{NY} = YS + \frac{YE - YS}{E - 1} \times N$$

It is possible to calculate position coordinates without using trigonometric functions by the use of not only the formula (7) but also the following formula (8). In the formula (8), (XS, YS) represents a position coordinate of the foremost nozzle 70 in the nozzle row, and (XE, YE) represents a position coordinate of a virtual point on the line extending from the nozzle row beyond the recording head 72 toward the rear end side.

$$NZL_{NX} = \frac{XS \times (257 - N) + XE \times (N - 1))}{256} \quad \text{Formula (8)}$$

$$NZL_{NY} = \frac{YS \times (257 - N) + YE \times (N - 1)}{256}$$

Figure 15:
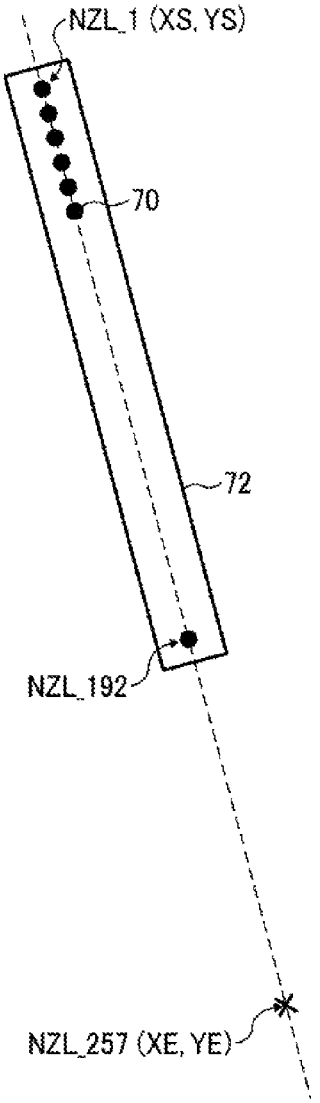
FIG. 15 is a schematic diagram for explaining another method of calculating the position of each of the nozzles in a simple manner.

In the embodiment illustrated in FIG. 15, 192 nozzles are lined up in a row at a regular interval equivalent to the distance e. The virtual point provided on the extending line is coincided with the position coordinate of the 257th nozzle. Accordingly, the position coordinate $(NZL_{NX}, NZL_{NY})$ of each one of the nozzles 70 can be calculated by a simple arithmetic operation in multiples of 2, which is much simpler than the formula (7).

Figure 16:
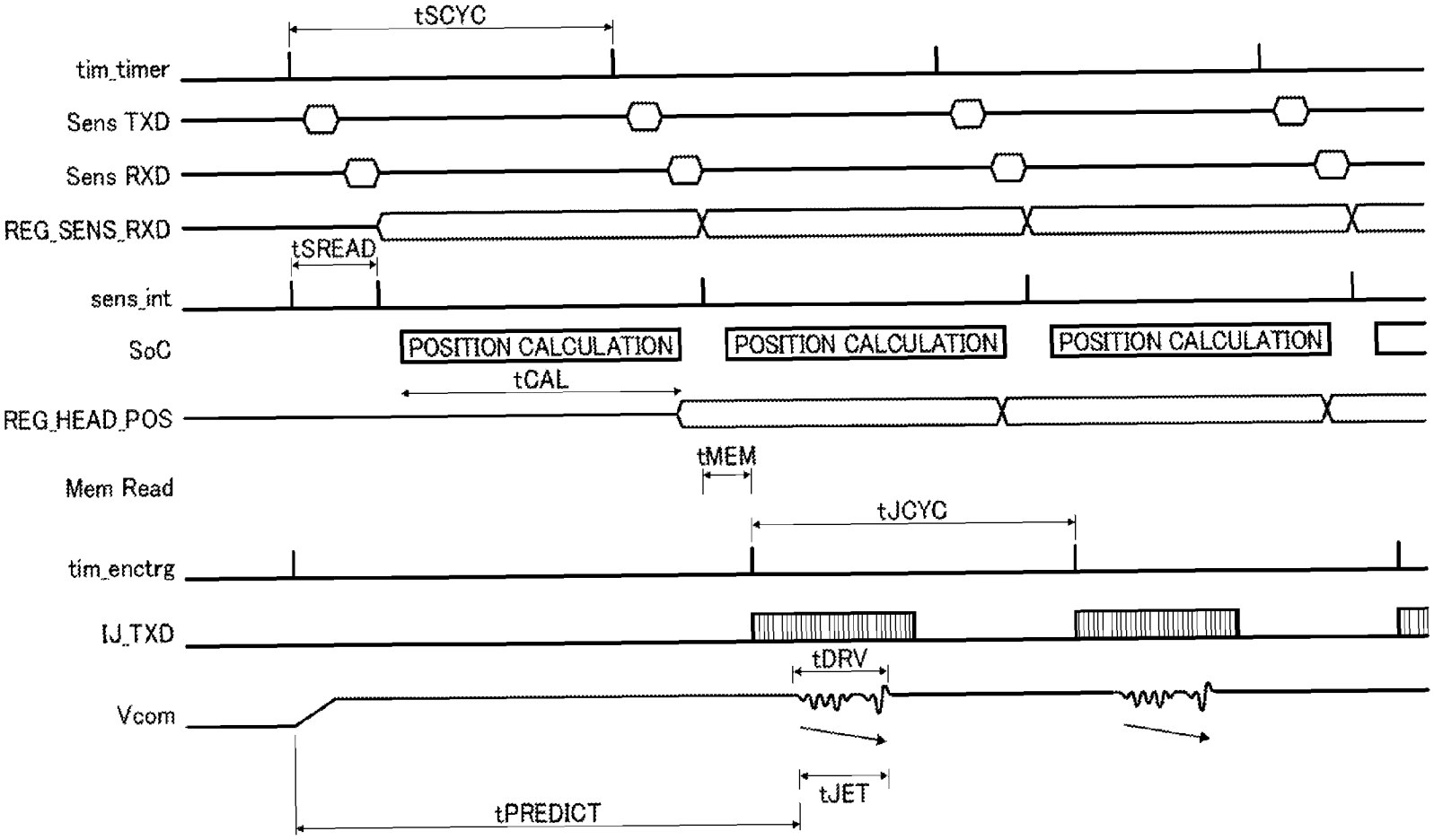
FIG. 16 is a timing diagram from when the position is calculated until the recording head discharges ink.

A timing for discharging ink after calculation of the position coordinate of each nozzle 70 is described below with reference to FIG. 16. The timing generation circuit 52 measures time, and the navigation sensor I/F 51 reads moving distances dX and dY of the sensor (SensTXD, SensTXD) according to a preset read timing, i.e., tim_timer that is an internal trigger. The read moving distances are stored in a register (REG_SENS_RXD). In FIG. 16, tSCYC represents a cycle of reading the moving distances of the sensor from the sensor (hereinafter "sensor readout"). In addition, tSREAD represents a time period required for the sensor readout.

Upon completion of the sensor readout, the interruption circuit 57 issues an interruption notification (sens_int) that notifies completion of the sensor readout. The SoC receives the notification, and the position calculation circuit 43 starts reading the moving distances stored in the register (REG_SENS_RXD) and calculating the present position coordinate of the sensor based on the read moving distances and the previous position coordinate. Upon completion of the calculation of the position coordinate, the calculation result is stored in a register (REG_HEAD_POS). In FIG. 16, tCAL represents a software processing time period in one cycle that is less than tSCYC.

Based on the calculated position coordinate, the ASIC 50 reads image data of a peripheral image from the memory 23 via the memory controller 42 (Mem Read). In FIG. 16, tMEM represents a time period required for preparing print data for the first discharge after receiving predicted values for the head position from the CPU 41. The recording head control circuit 53 transfers the print data to the recording head drive circuit 28 (U_TXD) according to a trigger of a recording head drive cycle (tim_enctrg). In FIG. 16, tJCYC represents a recording head drive cycle, tDRV represents a time period during which a drive waveform is actually given, tJET represents a time period from when the drive waveform is given until ink impacts on a print medium, and tPREDICT represents a time period from when time position information is read until the first dot is output, i.e., a time period during which the SoC 40 predicts the position.

Figures 17A, 17B:
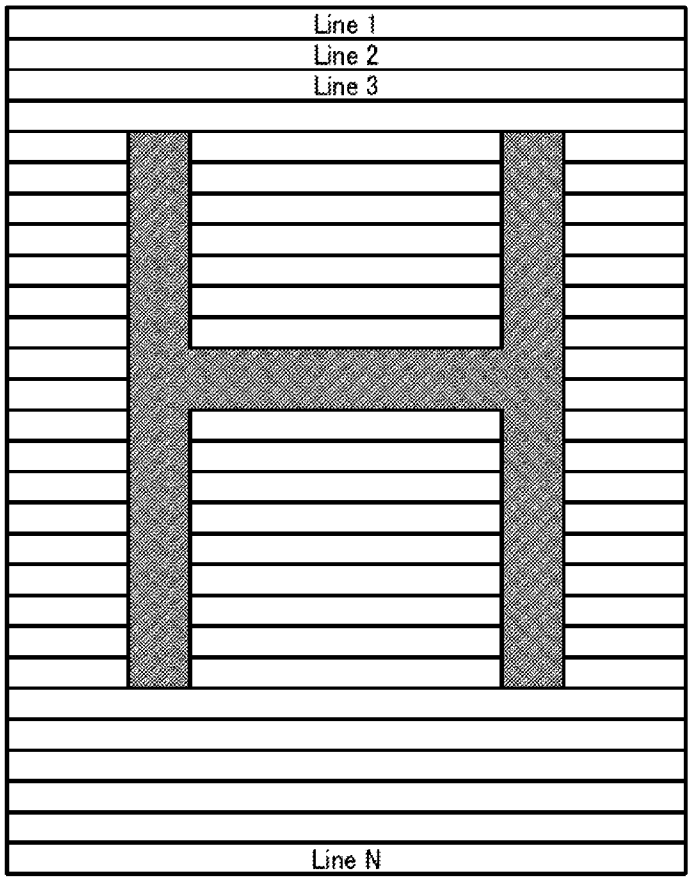
FIGS. 17A and 17B are schematic diagrams for explaining position information, image coordinate, and storage address for image data.

Print position of a print target image on a paper sheet, position coordinate of print data, and storage address in the memory 23 for print data are described below with reference to FIGS. 17A and 17B. Here, a print target image is a text "H". Image data input from the SoC 40 is divided into multiple lines as illustrated in FIG. 17A when stored in the memory 23. Each line consists of an image area having a block size of 1 dot×1 row. In accordance with some embodiments of the present invention, image data is not necessarily divided into multiple lines, and may be subjected to another processing.

The DMAC 55 in the ASIC 50 stores image data encompassing an image area spread over the multiple lines and the entire recording head along with a certain amount of margin in the image RAM 54. The DMAC 55 in the ASIC 50 stores image data of each of the lines 1 to N in a memory area having an assigned address as illustrated in FIG. 17B.

Coordinate values proceeding in one recording head drive cycle are described below with reference to FIG. 18. In the present embodiment, the maximum freehand scanning speed is 400 mm/s, ink discharge period, i.e., drive period, is 100 μs, data gradation is 2 bit per dot, and print resolution is 600 dpi. The amount of data required in moving within one drive cycle (i.e., a cycle of discharging 1 dot) under the above conditions is calculated as 1.9 bit as 1-direction data and 15.2 bit as peripheral 8-direction data. A 600-dpi coordinate conversion result of the amount of data comes to 0.95. This means that it is possible to discharge ink at intervals of 0.95 dots. Since the obtained interval is less than 1 dot, it is possible to sufficiently discharge ink while proceeding by 1 dot.

When discharging ink from one nozzle, the amount of 8-direction data is required since the printer moves not in one direction but in eight directions, i.e., vertical, lateral, oblique directions. In the present embodiment, the recording head has 192 nozzles. Therefore, the required amount of data is at least 1.9×8×192=2918.4 bit.

Figure 19:
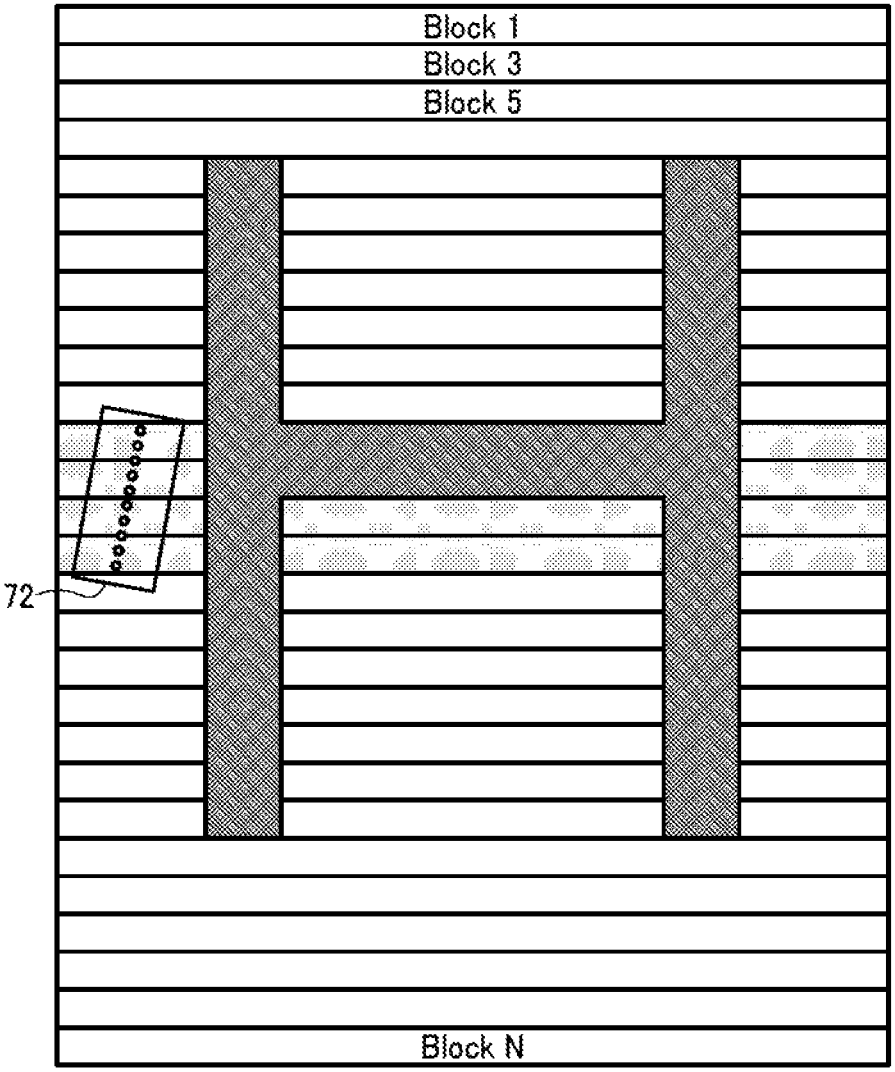
FIG. 19 is a schematic diagram for explaining position information and a transfer-necessary area that is an image area based on image data to be transferred.

When the DMAC 55 transfers the print data to the recording head control circuit 53, it is necessary that the data include data of the multiple lines since the recording head is spread over the multiple lines. In the embodiment illustrated in FIG. 19, the recording head 72 is spread over four lines. Therefore, block data corresponding to the four lines is read from the memory 23 and transferred. During the scanning of the hand-held printer 10 by a user, it is not always possible to constantly scan over four lines. Therefore, it is possible to read data corresponding to four lines and extra two lines above and below the four lines from the memory 23 and transfer it. Thus, even when the printer is displaced upward or downward by one line, it is possible to perform printing based on the transferred image data.

It is not always possible to make a print by a single scan in freehand scanning printing. This is because, if the calculated position coordinate of a nozzle does not coincide with the position coordinate of the transferred print data, no ink is discharged from the nozzle. Accordingly, the printed data is regularly compared with the print data by reading all the data to determine whether ink has actually discharged or not. This comparison does not need to perform in real time. To reduce processing load, the comparison can be performed at second order.

This comparison can be performed by, for example, forming an image based on image data, rewriting a portion onto which ink has discharged into white, and comparing the printed portion and the portion rewritten into white. This is merely one example, and other processes can be employed.

An operation for determining whether to discharge ink from the nozzles 70 is described below with reference to FIG. 20. A print target image may be printed at, for example, a dot density of 1,200 dpi. An image is formed by discharging ink from a nozzle toward an image coordinate which is to be printed based on the determination. The determination is based on whether or not the position coordinate of the nozzle coincides with the image coordinate. When this condition is satisfied, the nozzle is determined to discharge ink.

Figure 20:
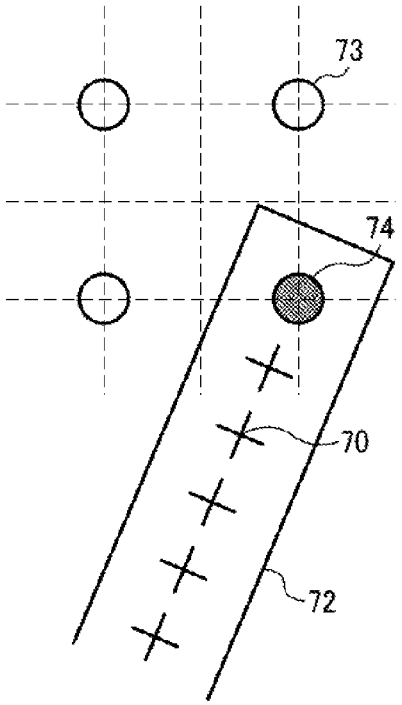
FIG. 20 is a schematic diagram for explaining a method of determining whether ink is to be discharged or not.

In the embodiment illustrated in FIG. 20, among image coordinates 73 represented by white circles, an image coordinate 74 represented by a black circle is coincided with the position coordinate of the foremost nozzle 70 on the recording head. Therefore, the foremost nozzle 70 is determined to discharge ink. Other nozzles coincided with image coordinates, if any, are also determined to discharge ink. By contrast, nozzles not coincided with image coordinates are determined not to discharge ink. The print data is output only to the nozzles determined to discharge ink, and these nozzles discharge ink to form an image.

Since the freehand scanning orbit depends on a user, an image is basically formed by repeating the scanning on the same portion multiple times. In the case where the nozzle pitch is extremely shorter than print resolution, it is possible to form an image by a single scan since many of the multiple nozzles coincide with image coordinates.

As illustrated in FIG. 20, whether to discharge ink or not from each nozzle 70 is basically determined by determining whether the position coordinate of the nozzle coincides with an image coordinate. Such a determination process is acceptable when the printing speed is low. However, when the printing speed is high, there may be many cases where the position coordinate of the nozzle does not coincide with an image coordinate. In such cases, a user has to repeat scanning multiple times. In view of this situation, for the purpose of reducing the number of scanning, the image coordinate is given a certain amount of margin. In particular, the discharge condition is set such that a nozzle is determined to discharge ink if the nozzle exists within a certain area.

Figure 21:
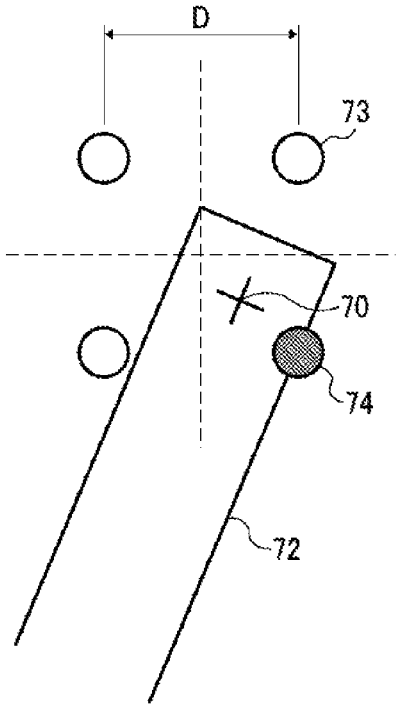
FIG. 21 is a schematic diagram for explaining another method of determining whether ink is to be discharged or not.

The certain area can be defined as, for example, an area including each image coordinate, as divided by dotted lines illustrated in FIG. 21. In FIG. 21, the foremost nozzle 70 exists in the bottom-right area containing the image coordinate 74. Therefore, the nozzle is determined to discharge ink at the present position for printing the image on the image coordinate 74. In this case, however, since the image coordinate 74 is not coincided with the position of the nozzle, ink is discharged onto a position deviated from the image coordinate 74. A maximum deviation amount $\delta_{max}$ is calculated from the following formula 9. In the formula 9, D represents a width of one dot with respect to print resolution.

$$\delta_{MAX} = D \times \frac{\sqrt{2}}{2} \quad \text{Formula (9)}$$

This determination process is acceptable even when the printing speed is high, although some deviations are generated. In particular, this process is preferable for printing visually-readable texts since the productivity increases.

In accordance with some embodiments of the present invention, a printer, a printing system, and a printing method are provided which realize precise detection of two-dimensional position and print control in freehand scanning. In accordance with some embodiments of the present invention, when the moving distance of the printer is calculated from a rotary movement component and parallel movement components that are calculated based on the previously-calculated rotary movement component, operation error can be reduced.

In accordance with some embodiments of the present invention, when a position of one of the sensors having a largest rotation angle is firstly calculated, and then positions of the other sensors are calculated based on the calculated position of the sensor having the largest rotation angle, operation error can be reduced. In accordance with some embodiments of the present invention, detection accuracy of a print medium having a rough surface such as paper is increased when LED is used as the light source. On the other hand, a glossy print medium such as a glass plate having a smooth surface is detectable when laser diode (LD) is used as the light source, providing a wide range of usable print media.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. A printer performing printing while being moved on a print medium, comprising:

a recording head having a plurality of nozzles that discharge liquid droplets;

two or more sensors each reading the print medium into an image of the print medium and calculating a total moving distance based on the image of the print medium;

an instruction unit that instructs a timing for discharging the liquid droplets from one or more of the nozzles to perform the printing;

a sensor position calculator that calculates a position of each of the sensors on the print medium relative to a predetermined initial position, based on the total moving distance calculated by each of the two or more sensors;

a nozzle position calculator that calculates a position of each of the nozzles on the print medium relative to the initial position, based on the positions of the sensors calculated by the sensor position calculator;

an acquisition unit that acquires image data of a specified area within an image to be printed, based on the position of each of the nozzles calculated by the nozzle position calculator;

a determination unit that determines whether or not to discharge the liquid droplets from each of the nozzles, based on the position of each of the nozzles calculated by the nozzle position calculator and a position of each of image elements constituting the specified area within the image printed on the print medium according to the image data of the specified area acquired by the acquisition unit;

a transmitter that transmits data of one or more of the image elements and information on one or more of the nozzles determined to discharge the liquid droplets to a controller that controls discharging of the liquid droplets, based on the timing instructed by the instruction unit and a determination result made by the determination unit;

wherein the total moving distance is calculated from:

a rotary movement component specified in a rotation direction based on the initial position, represented by a rotation angle;

parallel movement components each specified in longitudinal and transverse directions based on the initial position, represented by moving distances in the longitudinal and transverse directions, wherein the rotation angle is calculated prior to calculation of the moving distances, and the moving distances are calculated based on the rotation angle; and wherein the sensor position calculator firstly calculates a position of one of the sensors having a largest rotation angle, and then calculates positions of the other sensors based on the calculated position of the sensor having the largest rotation angle.

2. The printer according to claim 1, wherein the plurality of nozzles are arranged between the two or more sensors, and wherein the nozzle position calculator calculates the position of each of the nozzles from a distance between each of the sensors and the recording head, a distance between an end of the recording head and one of the nozzles closest thereto, a distance between two of the nozzles adjacent to each other, and the rotation angle.

3. The printer according to claim 1, wherein the plurality of nozzles are arranged between the two or more sensors, and wherein the nozzle position calculator calculates the position of each of the nozzles from a distance between each of the sensors and the recording head, a distance between an end of the recording head and one of the nozzles closest thereto, a distance between two of the nozzles adjacent to each other, and a length of the recording head.

4. The printer according to claim 1, wherein the determination unit determines to discharge the liquid droplets from each of the nozzles when the position of each of the nozzles coincides with the position of one of the image elements.

5. The printer according to claim 1, wherein the determination unit determines to discharge the liquid droplets from each of the nozzles when the position of each of the nozzles exists within a preset area including one of the image elements.

6. The printer according to claim 1, wherein each of the sensors includes a light source being a laser diode or a light emitting diode.

7. A printing system, comprising:

the printer according to claim 1; and an electronic device that transmits image data to the printer.

8. A method of printing by moving on a print medium, comprising:

reading the print medium by two or more sensors into an image of the print medium;

calculating a total moving distance based on the image of the print medium;

calculating a position of each of the sensors on the print medium relative to a predetermined initial position, based on the calculated total moving distance;

calculating a position of each of a plurality of nozzles on the print medium relative to the initial position, based on the calculated positions of the two or more sensors;

acquiring image data of an specified area within an image to be printed based on the position of each of the nozzles;

determining whether or not to discharge liquid droplets from each of the nozzles, based on the calculated position of each of the nozzles and a position of each of image elements constituting the specified area within the image printed on the print medium according to the acquired image data of the specified area;

controlling a timing for discharging the liquid droplets from one or more of the nozzles to perform the printing;

transmitting data of one or more of the image elements and information on one or more of the nozzles determined to discharge the liquid droplets to a controller that controls discharging of the liquid droplets, based on the timing instructed in the instructing and a determination result made in the determining, wherein the total moving distance is calculated from:

a rotary movement component specified in a rotation direction based on the initial position, represented by a rotation angle;

parallel movement components each specified in longitudinal and transverse directions based on the initial position, represented by moving distances in the longitudinal and transverse directions, wherein the rotation angle is calculated prior to calculation of the moving distances, and the moving distances are calculated based on the rotation angle; and wherein the sensor position calculator firstly calculates a position of one of the sensors having a largest rotation angle, and then calculates positions of the other sensors based on the calculated position of the sensor having the largest rotation angle.

* * * * *